US010900364B2

(12) United States Patent
Edwards et al.

(10) Patent No.: US 10,900,364 B2
(45) Date of Patent: Jan. 26, 2021

(54) GAS TURBINE ENGINE STATOR VANE SUPPORT

(71) Applicant: United Technologies Corporation, Farmington, CT (US)

(72) Inventors: William R. Edwards, Stratham, NH (US); Nicholas Hunnewell, North Berwick, ME (US)

(73) Assignee: RAYTHEON TECHNOLOGIES CORPORATION, Waltham, MA (US)

( * ) Notice: Subject to any disclaimer, the term of this patent is extended or adjusted under 35 U.S.C. 154(b) by 673 days.

(21) Appl. No.: 15/647,500

(22) Filed: Jul. 12, 2017

(65) Prior Publication Data

US 2019/0017398 A1 Jan. 17, 2019

(51) Int. Cl.
*F01D 9/04* (2006.01)
*F01D 25/24* (2006.01)

(52) U.S. Cl.
CPC ..... *F01D 9/042* (2013.01); *F01D 25/246* (2013.01); *F05D 2230/60* (2013.01); *F05D 2260/96* (2013.01); *F05D 2300/501* (2013.01)

(58) Field of Classification Search
CPC .. F01D 9/042; F01D 25/246; F05D 2300/501; F05D 2260/96; F05D 2230/60
See application file for complete search history.

(56) References Cited

U.S. PATENT DOCUMENTS 2,924,425 A 2/1960 Cutler
3,442,442 A * 5/1969 Seiwert ..... F01D 5/282 415/200
3,932,056 A * 1/1976 Tai ..... F01D 5/225 415/209.4
4,655,682 A * 4/1987 Kunz ..... F01D 9/042 415/119
4,889,470 A * 12/1989 Scalzo ..... F04D 29/542 415/209.2
5,765,993 A * 6/1998 Weiss ..... B23P 6/005 29/889.1
6,179,560 B1 * 1/2001 Kouris ..... F01D 9/042 415/190
6,296,442 B1 * 10/2001 Tran ..... F01D 9/042 29/889.22

(Continued)

FOREIGN PATENT DOCUMENTS

EP 1079075 A2 2/2001
EP 2204539 A2 7/2010
WO 9813585 A1 4/1998

OTHER PUBLICATIONS

European Search Report from the European Patent Office for EP Application No. 18183205.6 dated Nov. 28, 2018, 6 pages.

*Primary Examiner* — Hung Q Nguyen
*Assistant Examiner* — Susan E Scharpf
(74) *Attorney, Agent, or Firm* — Cantor Colburn LLP

(57) ABSTRACT

A stator vane assembly for a gas turbine engine includes an inner vane support defining a first aperture, an outer vane support defining a second aperture, a stator having an inner end that extends through the first aperture and an outer end that extends through the second aperture, and a first bracket. The first bracket is operatively connected to the inner vane support and extends over the first aperture. The first bracket and the inner vane support defining a first pocket.

17 Claims, 3 Drawing Sheets

(56) References Cited

U.S. PATENT DOCUMENTS

| | | | | |
|---|---|---|---|---|
| 6,619,917 | B2 * | 9/2003 | Glover | F01D 9/042 29/889.22 |
| 8,794,908 | B2 | 8/2014 | Dezouche et al. | |
| 9,534,498 | B2 * | 1/2017 | Lyders | F01D 9/042 |
| 9,617,870 | B2 * | 4/2017 | Chokshi | F01D 9/065 |
| 2008/0075588 | A1 * | 3/2008 | Belmonte | F01D 9/042 415/209.3 |
| 2012/0027604 | A1 * | 2/2012 | McDonald | F04D 29/542 416/219 R |
| 2014/0030077 | A1 * | 1/2014 | Von Arx | F01D 9/042 415/183 |
| 2014/0356158 | A1 * | 12/2014 | Barnett | F01D 9/042 415/209.3 |
| 2015/0030443 | A1 * | 1/2015 | Richardson | F01D 5/22 415/210.1 |
| 2016/0108931 | A1 * | 4/2016 | Wang | F01D 9/042 415/182.1 |
| 2017/0081979 | A1 * | 3/2017 | Fitzpatrick | F01D 9/02 |
| 2017/0306777 | A1 * | 10/2017 | Yagi | F01D 9/041 |
| 2018/0051579 | A1 * | 2/2018 | Montgomery | F04D 29/668 |
| 2018/0363505 | A1 * | 12/2018 | Dziech | F01D 25/246 |
| 2019/0010809 | A1 * | 1/2019 | Matsuo | F01D 25/00 |

* cited by examiner

GAS TURBINE ENGINE STATOR VANE SUPPORT

BACKGROUND

Exemplary embodiments pertain to the art of gas turbine engines.

The gas turbine engine may include a core that is supported by a case. The core may include stator vanes that are supported by the case to limit displacement of the stator vanes. The stator vanes are subjected to high pressures, high temperatures, and vibrations that may be transmitted to the case.

Accordingly, it is desirable to provide the stator vanes that are capable of withstanding the pressures, temperatures, and vibrations.

BRIEF DESCRIPTION

In one illustrative embodiment, a stator vane assembly for a gas turbine engine is provided. The stator vane assembly includes an outer vane support, an inner vane support, a stator, and a first bracket. The outer vane support has a first outer vane support surface and a second outer vane support surface disposed opposite the first outer vane support surface. The inner vane support has a first inner vane support surface and a second inner vane support surface disposed opposite the first inner vane support surface. The stator has an outer end that extends through the outer vane support and an inner end that extends through the inner vane support. The first bracket is operatively connected to the second inner vane support surface and extending over the inner end. The first bracket and the second inner vane support surface define a first pocket.

In addition to one or more of the features described herein, an elastomeric material is disposed within the first pocket.

In addition to one or more of the features described herein, the first bracket includes a first bracket first leg, a first bracket first wall extending between the first bracket first leg and a first bracket cap, and a first bracket second wall extending between the first bracket cap and a first bracket second leg.

In addition to one or more of the features described herein, the first pocket is defined by the second inner vane support surface, the first bracket first wall, the first bracket cap, and the first bracket second wall.

In addition to one or more of the features described herein, the inner end of the stator extends into the first pocket and is spaced apart from the first bracket cap.

In addition to one or more of the features described herein, the first bracket first leg is disposed on the second inner vane support surface.

In addition to one or more of the features described herein, the first bracket second leg is spaced apart from the second inner vane support surface and is disposed on a leg of an adjacent bracket disposed adjacent to the first bracket.

In another illustrative embodiment, a stator vane assembly for a gas turbine engine is provided. The stator vane assembly includes an inner vane support defining a first aperture, an outer vane support defining a second aperture, a stator having an inner end that extends through the first aperture and an outer end that extends through the second aperture, a first bracket, and a second bracket. The first bracket is operatively connected to the inner vane support and extends over the first aperture. The first bracket and the inner vane support defining a first pocket. The second bracket is operatively connected to the outer vane support and extends over the second aperture. The second bracket and the outer vane support defining a second pocket.

In addition to one or more of the features described herein, an elastomeric material is disposed within at least one of the first pocket and the second pocket.

In addition to one or more of the features described herein, the first bracket includes a first bracket first leg, a first bracket first wall extending from the first bracket first leg, a first bracket second leg, a first bracket second wall extending from the first bracket second leg, and a first bracket cap extending between the first bracket first wall and the first bracket second wall.

In addition to one or more of the features described herein, the inner end of the stator extends into the first pocket and extends towards the first bracket cap.

In addition to one or more of the features described herein, the second bracket includes a second bracket first leg, a second bracket first wall extending from the second bracket first leg, a second bracket second leg, a second bracket second wall extending from the second bracket second leg, and a second bracket cap extending between the second bracket first wall and the second bracket second wall.

In addition to one or more of the features described herein, the second bracket cap defines an opening.

In addition to one or more of the features described herein, the elastomeric material is injected into the second pocket through the opening.

In yet another illustrative embodiment, a gas turbine engine is provided. The gas turbine engine includes a stator have assembly having an inner vane support, an outer vane support, a stator, and a first bracket. The inner vane support defining a first aperture that extends through a first inner vane support surface and a second inner vane support surface. The outer vane support defining a second aperture that extends through a first outer vane support surface and a second outer vane support surface. The stator having an inner end that extends through the first aperture and an outer end that extends through the second aperture. The first bracket is operatively connected to the second inner vane support surface. The first bracket is disposed over the first aperture.

In addition to one or more of the features described herein, the first bracket includes a first bracket first leg that is disposed on the second inner vane support surface, a first bracket second leg spaced apart from first bracket first leg, a first bracket cap spaced apart from and disposed parallel to the first bracket first leg and the first bracket second leg, a first bracket first wall extending between the first bracket first leg and the first bracket cap, and a first bracket second wall extending between the first bracket second leg and the first bracket cap.

In addition to one or more of the features described herein, the second inner vane support surface, the first bracket first wall, the first bracket cap, and the first bracket second wall define a first pocket that is arranged to receive an elastomeric material.

In addition to one or more of the features described herein, a second bracket that is operatively connected to the second outer vane support surface, the second bracket disposed over the second aperture.

In addition to one or more of the features described herein, the second bracket includes a second bracket first leg that is spaced apart from the second outer vane support surface, a second bracket second leg spaced apart from second bracket first leg and is disposed on the second outer vane support surface, a second bracket cap spaced apart from and disposed parallel to the second bracket first leg and the second bracket second leg, a second bracket first wall extending between the second bracket first leg and the second bracket cap, and a second bracket second wall extending between the second bracket second leg and the second bracket cap.

In addition to one or more of the features described herein, the second outer vane support surface, the second bracket first wall, the second bracket cap, and the second bracket second wall define a second pocket that is arranged to receive an elastomeric material.

The above features and advantages, and other features and advantages of the disclosure are readily apparent from the following detailed description when taken in connection with the accompanying drawings.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
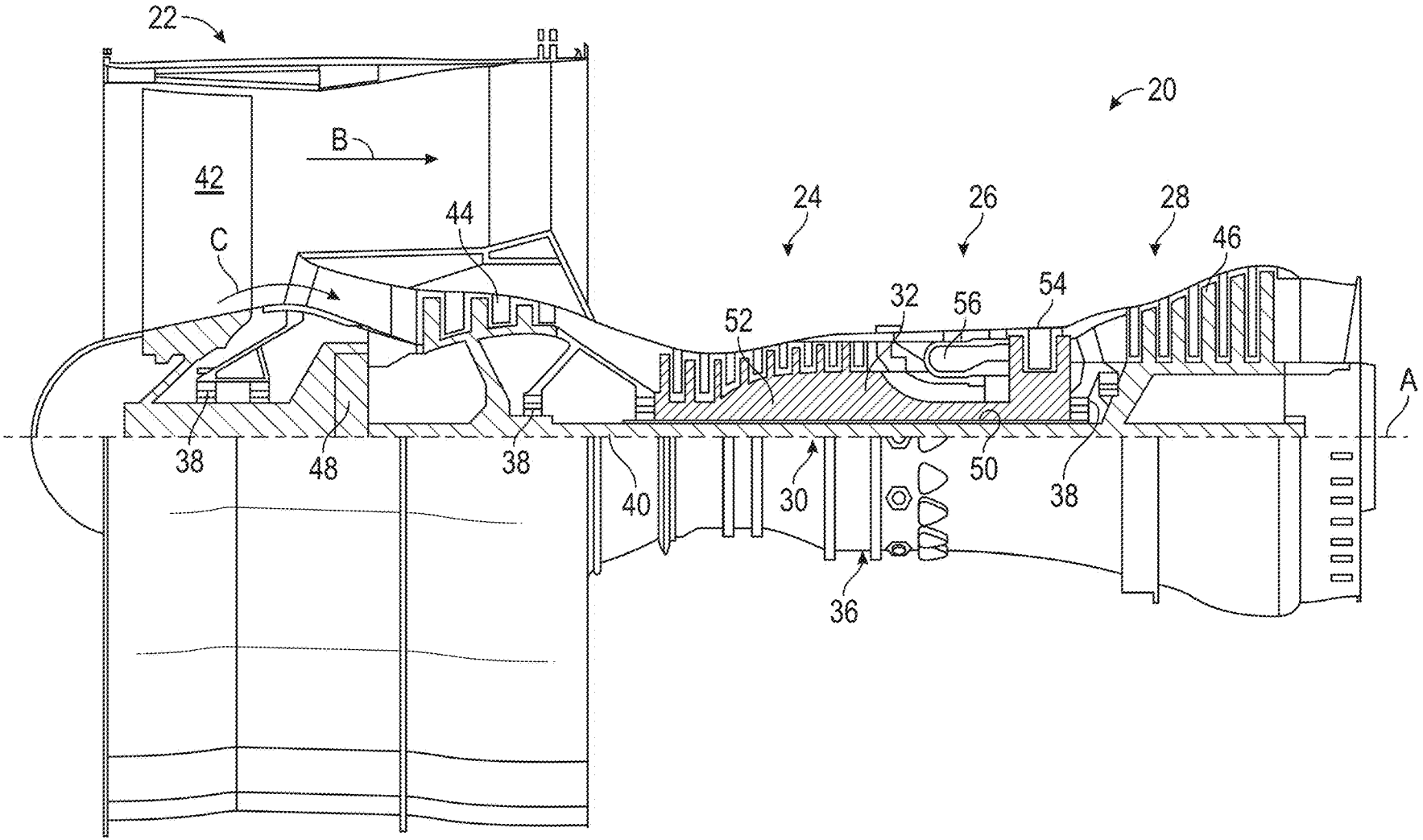
FIG. 1 is a schematic cross-sectional illustration of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed"

as disclosed herein according to one non-limiting embodiment is less than about 1150 ft/second (350.5 m/sec).

Referring to FIGS. 2-5, at least one of the compressor section 24 or the turbine section 28 is provided with a stator vane assembly 70. The stator vane assembly 70 may be circumferentially arranged about the longitudinal axis A. The stator vane assembly 70 may be supported by a case that is disposed about the core of the gas turbine engine 20. The stator vane assembly 70 includes an inner vane support 80, an outer vane support 82, a stator 84, and a bracket assembly 86.

Figure 2:
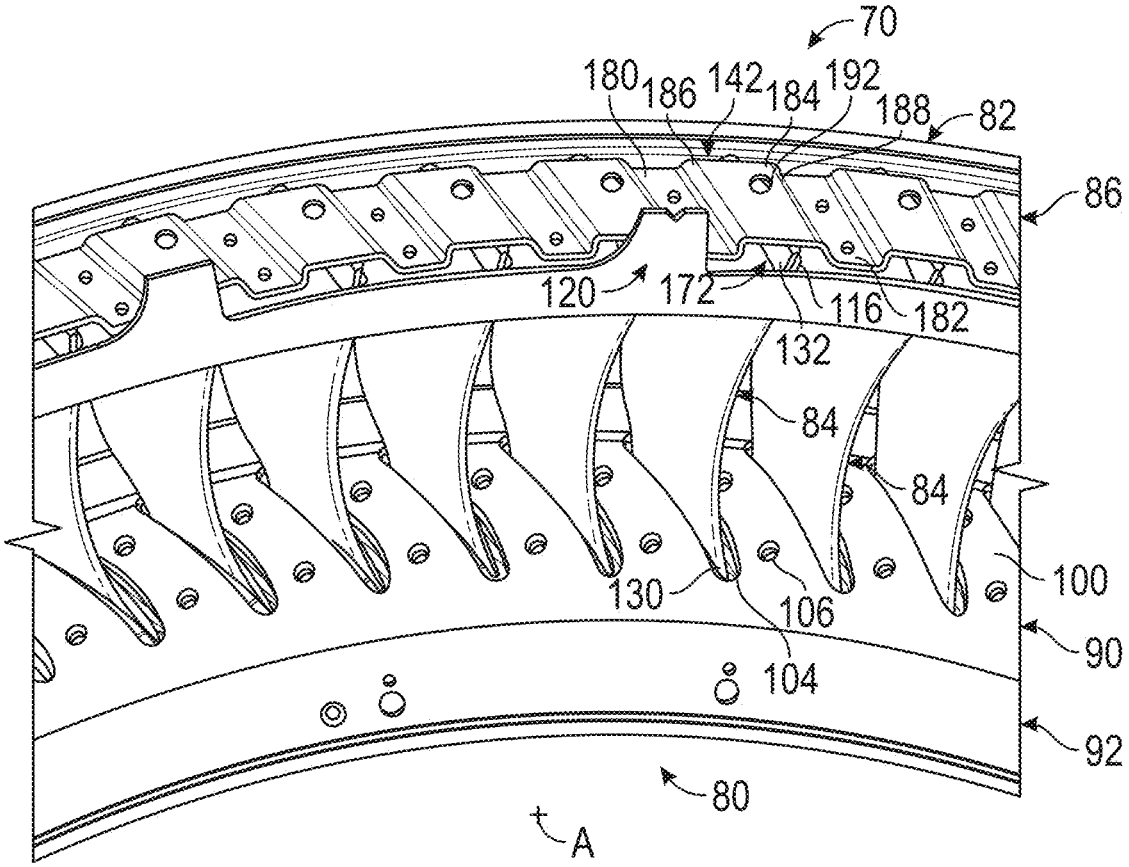
FIG. 2 is a schematic illustration of a first view of a vane assembly of a compressor section of the gas turbine engine.
Figure 4:
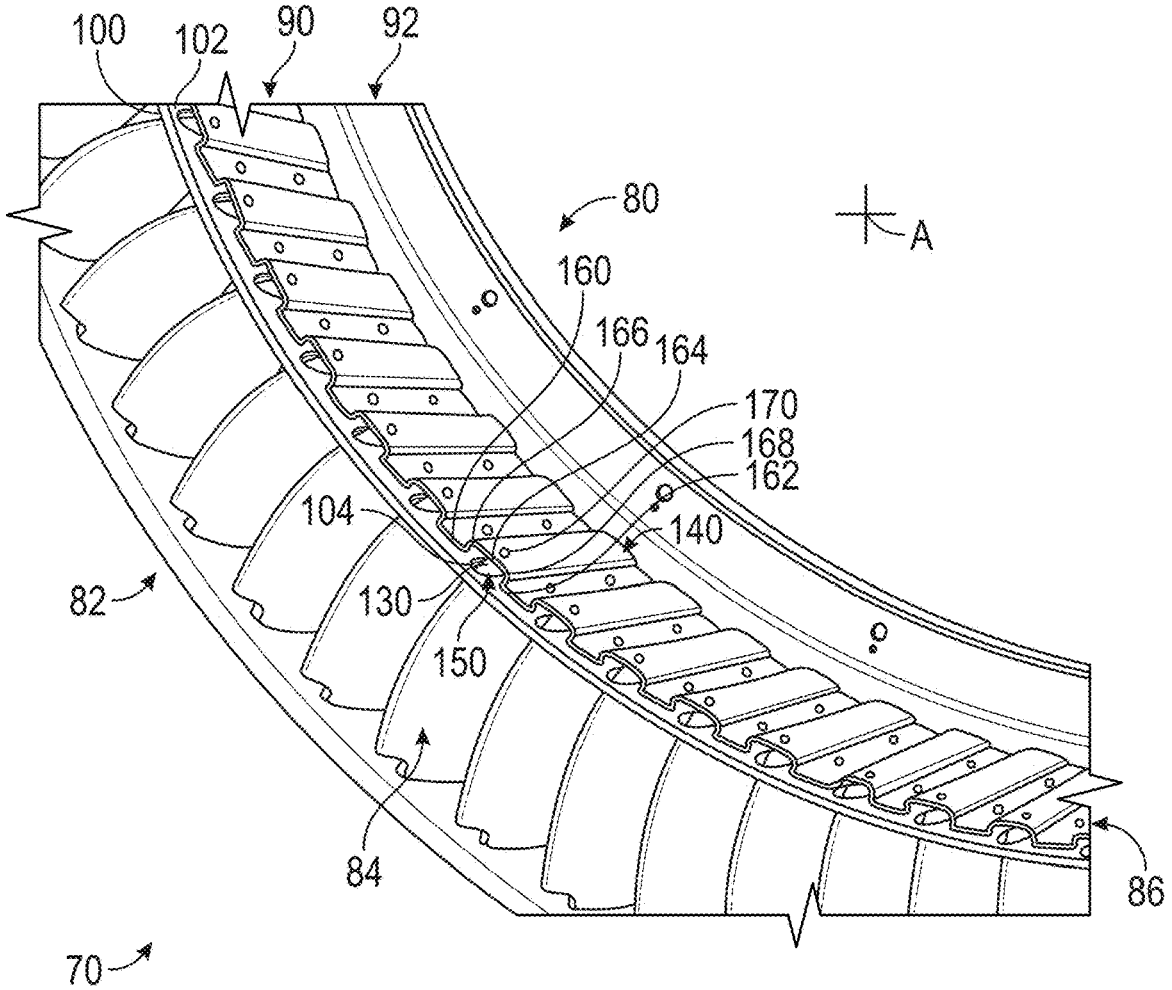
FIG. 4 is a schematic illustration of a second view of the vane assembly of the compressor section of the gas turbine engine.
Figure 5:
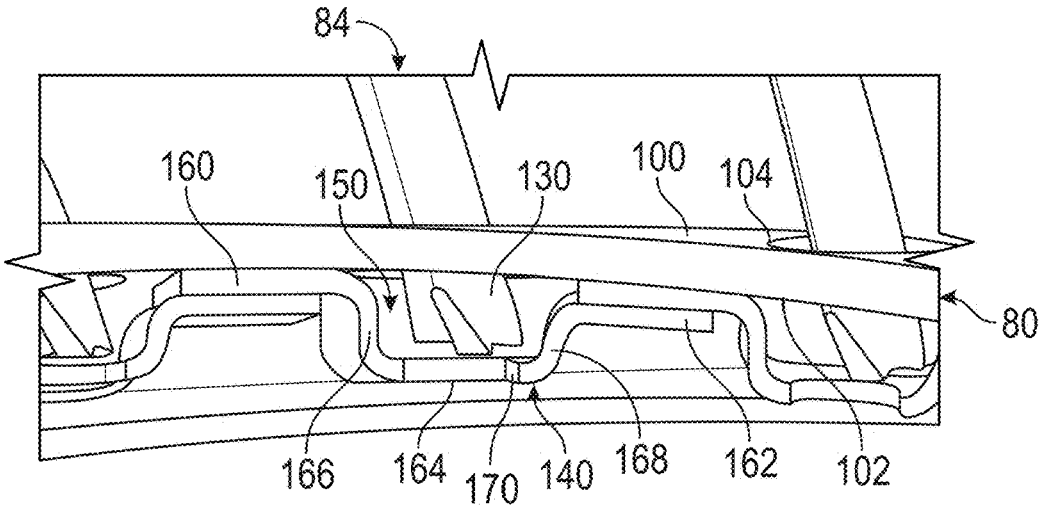
FIG. 5 is a schematic illustration of another portion of the vane assembly of FIG. 4.

Referring to FIGS. 2, 4, and 5, the inner vane support 80 may be commonly referred to as an inner shroud or an inner diameter shroud. The inner vane support 80 includes an inner vane support structure 90 and an inner vane support extension 92 that extends from the inner vane support structure 90.

The inner vane support structure 90 includes a first inner vane support surface 100 that faces away from longitudinal axis A and a second inner vane support surface 102 that is disposed opposite the first inner vane support surface 100 and faces towards the longitudinal axis A.

The inner vane support structure 90 defines a first slot or first aperture 104. The first aperture 104 extends from the second inner vane support surface 102 towards the first inner vane support surface 100. In at least one embodiment, the first aperture 104 extends completely through the first inner vane support surface 100 and the second inner vane support surface 102. The first aperture 104 is sized to receive at least a portion of the stator 84.

The inner vane support structure 90 may define a plurality of first apertures that are disposed adjacent to but spaced apart from each other such that a plurality of stator vanes may be disposed adjacent to each other. In at least one embodiment, the inner vane support structure 90 defines an inner vane support opening 106 that is disposed between adjacent first apertures of the inner vane support structure 90. The inner vane support opening 106 extends from the second inner vane support surface 102 towards the first inner vane support surface 100.

The inner vane support extension 92 extends from an end of the inner vane support structure 90 towards the longitudinal axis A. The inner vane support extension 92 is disposed substantially perpendicular to the inner vane support structure 90. The inner vane support extension 92 may be configured as a mounting flange to aid in mounting the inner vane support 80 of the stator vane assembly 70 to an inner case of the gas turbine engine 20.

Figure 3:
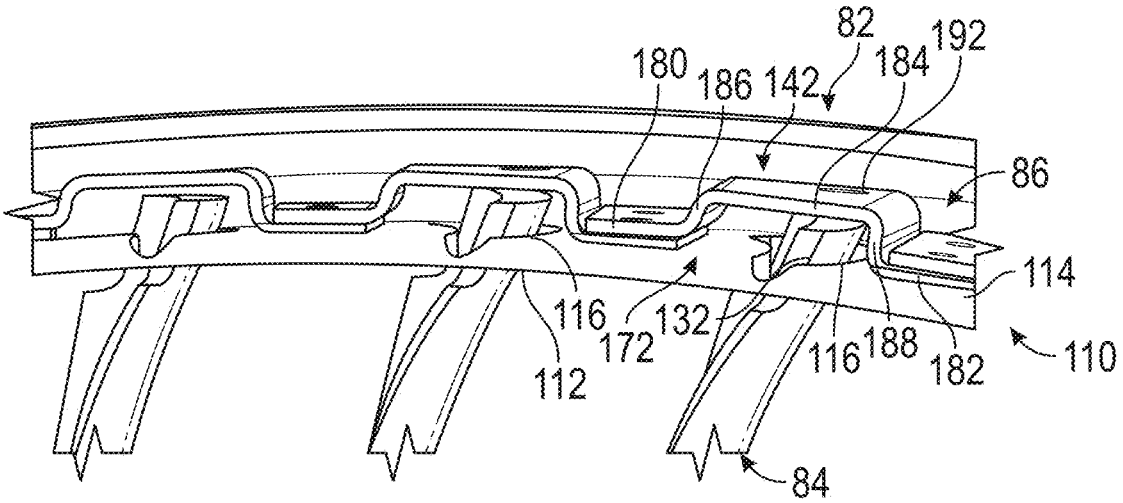
FIG. 3 is a schematic illustration of a portion of the vane assembly of FIG. 2.

Referring to FIGS. 2-4, the outer vane support 82 may commonly be referred to as an outer shroud or an outer diameter shroud. The outer vane support 82 includes an outer vane support structure 110 having a first outer vane support surface 112 that faces towards the longitudinal axis A and a second outer vane support surface 114 that is disposed opposite the first outer vane support surface 112 and faces away from the longitudinal axis A.

The outer vane support structure 110 defines a second slot or second aperture 116. The second aperture 116 extends from the first outer vane support surface 112 towards the second outer vane support surface 114. In at least one embodiment, the second aperture 116 extends completely through the first outer vane support surface 112. The second aperture 116 is sized to receive at least a portion of the stator 84 and is proximately radially aligned (relative to the longitudinal axis A) with the first aperture 104.

The outer vane support structure 110 may define a plurality of second apertures that are disposed adjacent to but spaced apart from each other such that a plurality of stator vanes may be disposed adjacent to each other. The outer vane support 82 may define a mounting feature 120 that extends from an end of the outer vane support structure 110. The mounting feature 120 may be configured as a hook that aids in mounting the outer vane support 82 of the stator vane assembly 70 to an outer case of the gas turbine engine 20.

The stator 84 extends between and is operatively connected to the inner vane support 80 and outer vane support 82. The stator 84 includes an inner end 130 and an outer end 132 that is disposed opposite the inner end 130. The inner end 130 extends into or extends through the first aperture 104 of the inner vane support 80. The outer end 132 extends into or extends through the second aperture 116 of the outer vane support 82.

The bracket assembly 86 includes a first bracket 140 that is operatively connected to the inner vane support 80 and a second bracket 142 that is operatively connected to the outer vane support 82.

Referring to FIGS. 4 and 5, the first bracket 140 may be a plurality of first brackets that are disposed adjacent to each other, or may be a plurality of first brackets that are operatively connected to each other, or may be a plurality of bracket segments that are joined together and disposed on the inner vane support 80.

The first bracket 140 is operatively connected to the second inner vane support surface 102. The first bracket 140 is disposed over the first aperture 104 and extends over the inner end 130 of the stator 84. The first bracket 140 and the second inner vane support surface 102 define a first pocket 150.

The first bracket 140 includes a first bracket first leg 160, a first bracket second leg 162, a first bracket cap 164, a first bracket first wall 166, and a first bracket second wall 168. The first bracket first leg 160 is disposed on the second inner vane support surface 102. The first bracket second leg 162 is spaced apart from the first bracket first leg 160. The first bracket second leg 162 may be disposed on the second inner vane support surface 102 or may be spaced apart from the second inner vane support surface 102 and may be disposed on a leg of an adjacent bracket that is disposed adjacent to the first bracket 140. The first bracket cap 164 is spaced apart from and is disposed substantially parallel to the first bracket first leg 160 and the first bracket second leg 162. In at least one embodiment, the first bracket cap 164 defines an opening 170. The first bracket first wall 166 extends between the first bracket first leg 160 and the first bracket cap 164. The first bracket second wall 168 is spaced apart from and disposed generally parallel to the first bracket first wall 166. The first bracket second wall 168 extends between the first bracket second leg 162 and the first bracket cap 164.

In at least one embodiment, the first bracket 140 includes a first closed end and/or a second closed end. The first closed end is defined by a first end wall that extends between proximal ends of the first bracket cap 164, the first bracket first wall 166, and the first bracket second wall 168 and extends towards the second inner vane support surface 102. The second closed end is defined by a second end wall that is disposed opposite the first end wall. The second end wall extends between distal ends of the first bracket cap 164, the first bracket first wall 166, and the first bracket second wall 168 and extends towards the second inner vane support surface 102.

As arranged, the first pocket 150 may be defined by the second inner vane support surface 102, the first bracket cap 164, the first bracket first wall 166, and the first bracket second wall 168. The inner end 130 of the stator 84 extends into the first pocket 150 and extends towards and is spaced apart from the first bracket cap 164.

The first pocket 150 is arranged to receive an elastomeric material that surrounds and supports the inner end 130 of the stator 84. In at least one embodiment, the elastomeric material may be retained within the first pocket 150 by at least one of the first end wall and the second end wall. The elastomeric material may be injected into the first pocket 150 through the opening 170. The elastomeric material may be a high temperature felt or a potting material that is disposed within the first pocket 150. The first bracket 140 reinforces the elastomeric material from loading and inhibits displacement of the elastomeric material from being disposed about the inner end 130 of the stator 84 and the first pocket 150. The first bracket 140 further provides a robust elastomeric airfoil connection and enables the elastomeric airfoil connection to resist higher temperature and pressure loads.

Referring to FIGS. 2 and 3, the second bracket 142 may be a plurality of second brackets that are disposed adjacent to each other, or may be a plurality of second brackets that are operatively connected to each other, or may be a plurality of bracket segments that are joined together and disposed on the outer vane support 82.

The second bracket 142 is operatively connected to the second outer vane support surface 114. The second bracket 142 is disposed over the second aperture 116 and extends over the outer end 132 of the stator 84. The second bracket 142 and the second outer vane support surface 114 define a second pocket 172. The second pocket 172 is arranged to receive an elastomeric material.

The second bracket 142 includes a second bracket first leg 180, a second bracket second leg 182, a second bracket cap 184, a second bracket first wall 186, and a second bracket second wall 188. The second bracket first leg 180 may be disposed on the second outer vane support surface 114 or may be spaced apart from the second outer vane support surface 114 and may be disposed on a leg of an adjacent bracket that is disposed adjacent to the second bracket 142. The second bracket second leg 182 is spaced apart from the second bracket first leg 180. The second bracket second leg 182 is disposed on the second outer vane support surface 114. The second bracket cap 184 is spaced apart from and is disposed substantially parallel to the second bracket first leg 180 and the second bracket second leg 182. In at least one embodiment, the second bracket cap 184 defines an opening 192. The second bracket first wall 186 extends between the second bracket first leg 180 and the second bracket cap 184. The second bracket second wall 188 extends between the second bracket second leg 182 and the second bracket cap 184.

In at least one embodiment, the second bracket 142 includes a first closed end and/or a second closed end. The first closed end is defined by a first end wall that extends between proximal ends of the second bracket cap 184, the second bracket first wall 186, and the second bracket second wall 188 and extends towards the second inner vane support surface 102. The second closed end is defined by a second end wall that is disposed opposite the first end wall. The second end wall extends between distal ends of the second bracket cap 184, the second bracket first wall 186, and the second bracket second wall 188 and extends towards the second outer vane support surface 114.

As arranged, the second pocket 172 may be defined by the second outer vane support surface 114, the second bracket cap 184, the second bracket first wall 186, and the second bracket second wall 188. The outer end 132 of the stator 84 extends into the second pocket 172 and extends towards and is spaced apart from the second bracket cap 184.

The second pocket 172 is also arranged to receive an elastomeric material that surrounds and supports the outer end 132 of the stator 84. In at least one embodiment, the elastomeric material may be retained within the second pocket 172 by at least one of the first end wall and the second end wall. The elastomeric material may be injected into the second pocket 172 through the opening 192. The elastomeric material may be injected into the second pocket 172 through the opening 192. The elastomeric material may be a high temperature felt or a potting material that is disposed within the second pocket 172. The second bracket 142 reinforces the elastomeric material from loading and inhibits displacement of the elastomeric material from being disposed about the outer end 132 of the stator 84 and the second pocket 172. The second bracket 142 further provides a robust elastomeric airfoil connection and enables the elastomeric airfoil connection to resist higher temperature and pressure loads.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A stator vane assembly for a gas turbine engine, comprising:

an outer vane support having a first outer vane support surface and a second outer vane support surface disposed opposite the first outer vane support surface;

an inner vane support having a first inner vane support surface and a second inner vane support surface disposed opposite the first inner vane support surface;

a stator having an outer end that extends through the outer vane support and an inner end that extends through the inner vane support; and a first bracket operatively connected to the second inner vane support surface and extending over the inner end, the first bracket and the second inner vane support surface defining a first pocket, the first bracket having a first bracket first leg, a first bracket first wall extending between the first bracket first leg and a first bracket cap, and a first bracket second wall extending between the first bracket cap and a first bracket second leg, the first bracket first leg being disposed on the second inner vane support surface and the first bracket second leg is spaced apart from the second inner vane support surface and is disposed on a leg of an adjacent bracket disposed adjacent to the first bracket.

2. The stator vane assembly of claim 1, further comprising an elastomeric material that is disposed within the first pocket.

3. The stator vane assembly of claim 1, wherein the first pocket is defined by the second inner vane support surface, the first bracket first wall, the first bracket cap, and the first bracket second wall.

4. The stator vane assembly of claim 1, wherein the inner end of the stator extends into the first pocket and is spaced apart from the first bracket cap.

5. A stator vane assembly for a gas turbine engine, comprising:

an inner vane support defining a first aperture;

an outer vane support defining a second aperture;

a stator having an inner end that extends through the first aperture and an outer end that extends through the second aperture;

a first bracket operatively connected to the inner vane support and extends over the first aperture, the first bracket and the inner vane support defining a first pocket; and a second bracket operatively connected to the outer vane support and extends over the second aperture, the second bracket and the outer vane support defining a second pocket, wherein a first bracket first leg of the first bracket is located between a first bracket second leg of an adjacent first bracket and the inner vane support and a second bracket second leg of the second bracket is located between the outer vane support and a second bracket first leg of an adjacent second bracket.

6. The stator vane assembly of claim 5, further comprising an elastomeric material that is disposed within at least one of the first pocket and the second pocket.

7. The stator vane assembly of claim 6, wherein the first bracket further includes, a first bracket first wall extending from the first bracket first leg, a first bracket second leg, a first bracket second wall extending from the first bracket second leg, and a first bracket cap extending between the first bracket first wall and the first bracket second wall.

8. The stator vane assembly of claim 7, wherein the inner end of the stator extends into the first pocket and extends towards the first bracket cap.

9. The stator vane assembly of claim 7, wherein the second bracket further includes, a second bracket first wall extending from a second bracket first leg, a second bracket second wall extending from the second bracket second leg, and a second bracket cap extending between the second bracket first wall and the second bracket second wall.

10. The stator vane assembly of claim 9, wherein the second bracket cap defines an opening.

11. The stator vane assembly of claim 10, wherein the elastomeric material is injected into the second pocket through the opening.

12. A gas turbine engine, comprising:

a stator vane assembly provided with a compressor section, the stator vane assembly comprising:

an inner vane support defining a first aperture that extends through a first inner vane support surface and a second inner vane support surface;

an outer vane support defining a second aperture that extends through a first outer vane support surface and a second outer vane support surface;

a stator having an inner end that extends through the first aperture and an outer end that extends through the second aperture;

a first bracket that is operatively connected to the second inner vane support surface, the first bracket disposed over the first aperture;

a second bracket operatively connected to the second outer vane support surface, wherein a first bracket first leg of the first bracket is located between a first bracket second leg of an adjacent first bracket and the second inner vane support surface and a second bracket second leg of the second bracket is located between the second outer vane support surface and a second bracket first leg of an adjacent second bracket.

13. The gas turbine engine of claim 12, wherein the first bracket further includes, a first bracket second leg spaced apart from first bracket first leg, a first bracket cap spaced apart from and disposed parallel to the first bracket first leg and the first bracket second leg, a first bracket first wall extending between the first bracket first leg and the first bracket cap, and a first bracket second wall extending between the first bracket second leg and the first bracket cap.

14. The gas turbine engine of claim 13, wherein the second inner vane support surface, the first bracket first wall, the first bracket cap, and the first bracket second wall define a first pocket that is arranged to receive an elastomeric material.

15. The gas turbine engine of claim 12, wherein the second bracket is disposed over the second aperture.

16. The gas turbine engine of claim 15, wherein second bracket further comprises; a second bracket cap spaced apart from and disposed parallel to a first leg of the second bracket first leg and the second bracket second leg, a second bracket first wall extending between the second bracket first leg and the second bracket cap, and a second bracket second wall extending between the second bracket second leg and the second bracket cap.

17. The gas turbine engine of claim 16, wherein the second outer vane support surface, the second bracket first wall, the second bracket cap, and the second bracket second wall define a second pocket that is arranged to receive an elastomeric material.

* * * * *